United States Patent [19]

Kuhl

[11] 4,386,747

[45] Jun. 7, 1983

[54] PROJECTILE STABILIZATION FROM SMOOTH BORE BARREL

[76] Inventor: Raymond D. Kuhl, 134 Aranda St., NE., St. Petersburg, Fla. 33704

[21] Appl. No.: 310,602

[22] Filed: Oct. 9, 1981

[51] Int. Cl.[3] ..... F42B 13/00

[52] U.S. Cl. ..... 244/3.1; 102/501

[58] Field of Search ..... 244/3.1, 3.3; 102/501, 102/516, 517, 206

[56] References Cited

U.S. PATENT DOCUMENTS

| | | | |
|---|---|---|---|
| 18,568 | 11/1857 | Bates | 244/3.3 |
| 1,316,363 | 9/1919 | Hayden | 244/3.1 |
| 3,853,062 | 12/1974 | Cole | 102/206 |

FOREIGN PATENT DOCUMENTS

| | | | |
|---|---|---|---|
| 1428685 | 2/1969 | Fed. Rep. of Germany | 244/3.3 |

*Primary Examiner*—Charles T. Jordan

*Attorney, Agent, or Firm*—Duckworth, Allen, Dyer & Pettis

[57] ABSTRACT

A projectile for use with a smooth bore barrel is disclosed wherein longitudinal stability is provided by an oscillating mass within the projectile. A mass is disposed inside the projectile and attached and secured to the projectile by means of a bi-convex spring or equivalent flexible structure so that the mass is set off in oscillation upon the sudden acceleration due to the firing of the projectile. The inertial forces developed by the oscillating mass provide stability throughout the projectile's trajectory.

8 Claims, 11 Drawing Figures

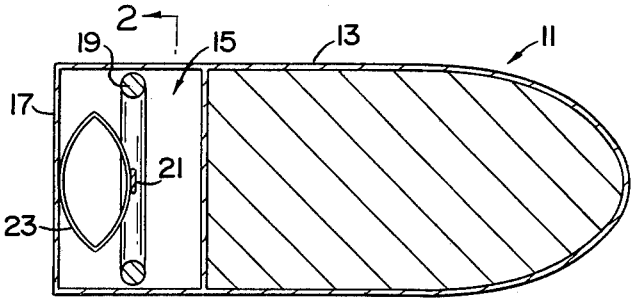
FIG. 1
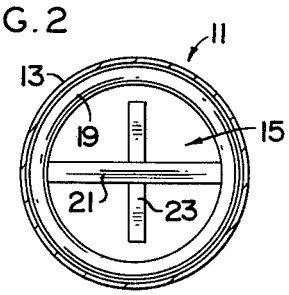
FIG. 2
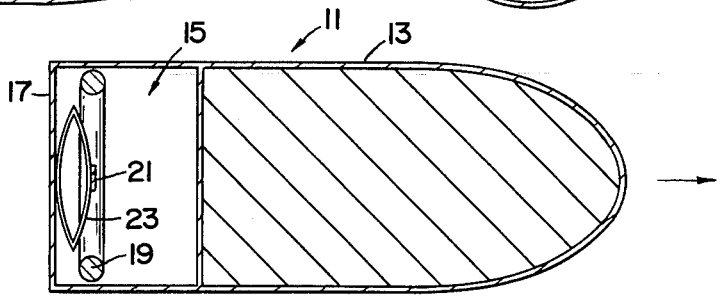
FIG. 3
FIG. 4
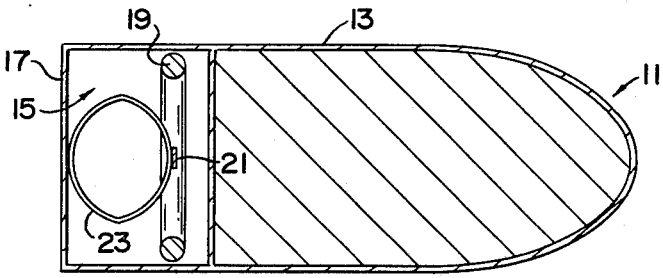
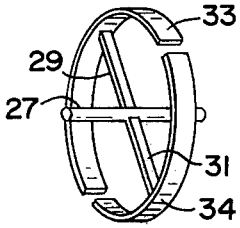
FIG. 8
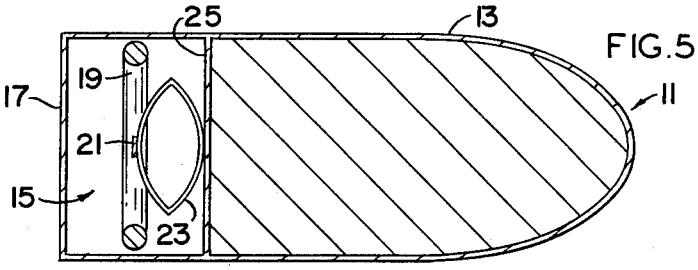
FIG. 5
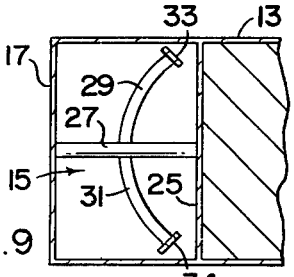
FIG. 9
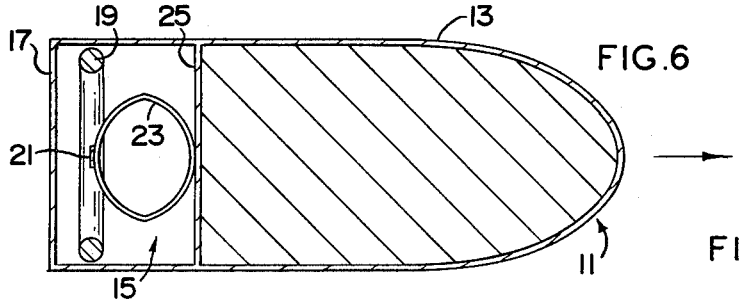
FIG. 6
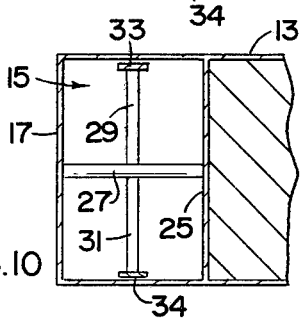
FIG. 10
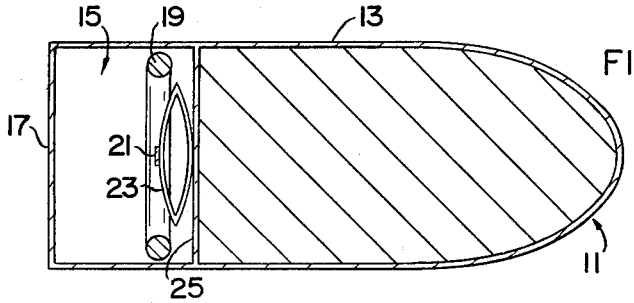
FIG. 7
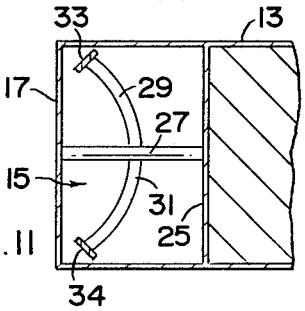
FIG. 11

PROJECTILE STABILIZATION FROM SMOOTH BORE BARREL

BACKGROUND OF THE INVENTION

This invention relates to projectiles for use with weapons having smooth bore barrels, and more particularly with a projectile wherein longitudinal stability is provided by an oscillating mass.

Numerous devices have been developed for providing longitudinal stability for projectiles to be fired from smooth bore barrels. Among the earliest to be described in the literature are those described in U.S. Pat. No. 107,909 (Hope, Oct. 4, 1870); U.S. Pat. No. 603,003 (Borelli, Aug. 16, 1898); U.S. Pat. No. 1,278,786 (Teleszky, Dec. 26, 1917). Other more recent disclosures include U.S. Pat. No. 3,292,879 (Chilowsky, Dec. 20, 1966); and U.S. Pat. No. 3,888,175 (Dusoe, June 10, 1975). In those devices aerodynamic means for providing stability are used and are deployed by numerous mechanical means. Other references which may be of interest include U.S. Pat. No. 3,452,677 (Abela, July 1, 1969); and U.S. Pat. No. 1,536,494 (Henkes, May 5, 1925).

SUMMARY OF THE INVENTION

The improved munition of this type, according to the present invention, is characterized by an oscillating mass disposed entirely within the projectile. The present invention thus enables the preclusion of any protrusion or ejection of aerodynamic means from the projectile. The oscillating mass is given the initial impulse for its oscillation by the firing of the projectile, and said oscillating mass provides stability throughout the projectile's trajectory.

BRIEF DESCRIPTION OF THE DRAWINGS

Further details are explained below with the help of the examples illustrated in the attached drawings in which:

FIG. 1 shows the projectile in cross section with the spring relaxed and the oscillating mass in the neutral position;

FIG. 2 shows the projectile in cross section through Section 2—2 of FIG. 1;

FIG. 3 shows the projectile in cross section with the spring fully compressed and the oscillating mass at its full rearward position.

FIG. 4 shows a cross section of the projectile with the spring fully extended and the oscillating mass at its full forward position;

FIG. 5 shows a cross section through an alternate embodiment of the projectile wherein the spring is attached to the body of the projectile with the spring relaxed and the oscillating mass is at its neutral position;

FIG. 6 is the embodiment of FIG. 5 with the spring fully extended and the oscillating mass at its full rearward position.

FIG. 7 illustrates the embodiments of FIGS. 5 and 6 with the spring fully compressed and the oscillating mass at its full forward position;

FIG. 8 illustrates an alternative embodiment for the vibrating mass;

FIG. 9 illustrates the mass of FIG. 8 at its maximum forward flexing position;

FIG. 10 illustrates the neutral position; and

FIG. 11 illustrates the maximum rearward flexing of the mass of FIG. 10.

DESCRIPTION OF THE INVENTION

In the drawings a projectile 11 includes an elongated projectile housing 13 provided with a cavity 15 disposed at the rear portion of projectile 11 (see FIG. 1). The projectile is terminated by a rear base plate 17 which may be integrally formed with the projectile housing 13 (in which case access to cavity 15 is provided through the periphery) or may be in the form of a plate attached to the housing 13. Disposed inside the cavity 15 is a toroidal mass 19 (although other geometic configurations may be used). The mass 19 is provided with a radially disposed spoke 21 passing through the center of the toroid. A bi-convex spring 23 is attached to a spoke 21 and also to a rear plate 17. The operation of the device is illustrated by FIGS. 3 and 4, wherein FIG. 3 illustrates the position of the toroidal mass 19 at the moment of firing. The acceleration imparted by the propellant of the projectile 11 will be imparted immediately to the mass 19. As the projectile is accelerated, the mass 19 will have a tendency to compress bi-convex spring 23, until said spring acquires a sufficient compression tension to counteract the force generated due to the acceleration of the projectile 11 (see FIG. 3). After the projectile 11 is outside of the influence of the propellant, the positive acceleration of the projectile 11 will cease. At this point, the bi-convex spring 23, utilizing the tension energies acquired as it alternates between extreme compressed and extended modes, will impose acceleration forces on the mass 19 and thus maintain the oscillatory motion of said mass 19. Illustrated in FIG. 4 is the bi-convex spring at the fully extended position. The fundamental oscillation of the mass 19 will then provide longitudinal stability in the projectile 11.

An alternate embodiment (illustrated in FIGS. 5 through 7) includes a partition wall 25 to which bi-convex spring 23 can be attached. The operation of the device is similar as in the previous embodiment, except that upon initial acceleration, the bi-convex spring 23 will be extended until the acceleration decreases to the point where the tension of said extended bi-convex spring 23 forces the mass to go into oscillation.

Yet another alternate embodiment is illustrated in FIG. 8 in which the vibrating mass includes a central post 27 disposed inside of cavity 15, the ends of which are secured to the rear base plate 17 and to the partition wall 25 respectively. A pair of radially disposed spokes 29 and 31, having a predetermined property of flexibility, are attached to the post 27. A pair of semicylindrical masses 33 and 34 are attached to the spokes 29 and 31. It should be understood that although two spokes and masses are illustrated in FIG. 8, numerous other embodiments, such as three spokes with three masses, etc., may be utilized. As illustrated in FIG. 10, when the projectile 13 is at rest, the spokes 29 and 31 would be substantially parallel to the partition wall 25 and the end plate 17. When the projectile is fired, therefore undergoing substantial acceleration, spokes 29 and 31 will undergo substantial flexing, thereby allowing masses 33 and 34 to undergo a pendular motion. When the acceleration is removed, spokes 29 and 31 will act as springs and will set off pendular oscillation on mass 33 and 34. The oscillation will continue for a substantial portion of the flight of the projectile 11. The oscillation will provide substantial longitudinal stability to the projectile without the need for aerodynamic surfaces on the projectile, or in the alternative spin imparted by a rifled barrel. The advantages occuring to the use of the projectile 11 of the present invention is that it can be used with a smooth bore, and yet provide substantial longitudinal stability of the projectile.

It is, of course, to be understood in each of the various constructions shown and described above, that sufficient space is provided between the oscillating mass and the projectile house to permit substantially friction-free fundamental oscillation. That is to say, for example, neither toroidal mass 19, nor semi-cylindrical masses 33 and 34, would contact any portion of housing 13. It is also to be understood that the cross-sectional configurations of toroidal mass 19 and semi-cylindrical masses 33 and 34 are not limited to those illustrated in the several views of the drawings. It is desireable only to provide a construction whereby maximum mass is disposed for fundamental oscillation.

It will thus be seen that the objects set forth above, among those made apparent from the preceding description, are efficiently attained, and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A projectile for use with a smooth bore weapon comprising;

an elongated body with a leading edge and a cavity formed at its trailing edge;

a rear base plate attached to said elongated body thereby enclosing said cavity; and a longitudinally oscillating member disposed within said cavity, said oscillating member comprising a toroidal mass disposed within said cavity and a spring disposed in interconnecting relation between said rear base plate and said toroidal mass whereby sudden acceleration of the projectile will result in longitudinal oscillation of said toroidal mass.

2. The projectile of claim 1 further comprising a radial spoke extending through the center of said toroidal mass, each end of said spoke being attached to said toroidal mass, and said spoke being attached to said spring.

3. The projectile of claim 1 wherein said oscillating member comprises:

a toroidal mass disposed within said cavity; and a spring disposed in interconnecting relation between said elongated body and said toroidal mass whereby sudden acceleration of the projectile will result in longitudinal oscillation of said toroidal mass.

4. The projectile of claim 3 further comprising a radial spoke extending through the center of said toroidal mass, each end of said spoke being attached to said mass, and said spoke being attached to said spring.

5. A projectile for use with a smooth bore weapon comprising;

an elongated body with a leading edge and a cavity formed at its trailing edge;

a rear base plate attached to said elongated body thereby enclosing said cavity; and a longitudinally oscillating member disposed within said cavity, said oscillating member comprising a central post disposed in said cavity and attached to said body and said rear base plate, a plurality of non-rigid radially disposed spokes each attached to said central post, and a corresponding plurality of ring segments, each of said ring segments being attached to the distal end of a corresponding one of said spokes, whereby sudden acceleration of the projectile will result in pendular oscillation of said segmented rings about said central post.

6. The projectile of claim 5 wherein said plurality of spokes comprises:

three spokes equally angularly disposed about said central post; and said corresponding plurality of ring segments comprises three cylindrical segments, each one attached to one of said spokes.

7. A projectile for use with a smooth bore weapon comprising:

an elongated body;

a mass disposed within said elongated body; and means comprising a leaf spring for longitudinally oscillating said mass within said body.

8. The device of claim 7 wherein said mass comprises a cylindrical member.

* * * * *